US012492060B2

(12) United States Patent
Xu et al.

(10) Patent No.: US 12,492,060 B2
(45) Date of Patent: Dec. 9, 2025

(54) MASON JAR SEALING STRUCTURE

(71) Applicants: Shizan Xu, Shenzhen (CN); Bin Zeng, Shenzhen (CN)

(72) Inventors: Shizan Xu, Shenzhen (CN); Bin Zeng, Shenzhen (CN)

(73) Assignees: Shenzhen SETOO Technology Co., Ltd., Shenzhen (CN); Shenzhen Joy Innovation Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/657,785

(22) Filed: May 8, 2024

(65) Prior Publication Data

US 2025/0229970 A1 Jul. 17, 2025

(30) Foreign Application Priority Data

Jan. 16, 2024 (CN) ..... 202420098819.5

(51) Int. Cl.
*B65D 81/20* (2006.01)

(52) U.S. Cl.
CPC ..... *B65D 81/2038* (2013.01); *B65D 2543/00092* (2013.01)

(58) Field of Classification Search
CPC ..... B65D 81/2038; B65D 2543/00092
USPC ..... 206/524.8; 215/228, 260, 262, 270; 220/578, 580
See application file for complete search history.

(56) References Cited

U.S. PATENT DOCUMENTS

| | | | | |
|---|---|---|---|---|
| 2,751,073 | A * | 6/1956 | Sheeran | B65D 51/00 206/524.5 |
| 4,874,108 | A * | 10/1989 | Valasek | B44D 3/12 220/578 |
| 4,998,638 | A * | 3/1991 | Kawamata | B65D 79/0087 220/721 |
| 5,339,981 | A * | 8/1994 | Kral | B44D 3/12 220/287 |
| 6,478,218 | B1 * | 11/2002 | Boatwright | B65D 51/26 229/125.05 |
| 6,739,500 | B1 * | 5/2004 | Gentile | B65D 25/16 206/524.8 |
| 2006/0180591 | A1 * | 8/2006 | Porter | B65D 43/022 220/580 |
| 2019/0256260 | A1 * | 8/2019 | Carver | B65D 45/325 |

* cited by examiner

*Primary Examiner* — Luan K Bui

(57) ABSTRACT

A Mason jar sealing structure, comprising a sealing cover, and a flexible part is provided on the sealing cover; the flexible part is located corresponding to position of negative pressure end of negative pressure pump; a Mason jar body, which is internally hollow, and the sealing cover is set covering opening of the upper Mason jar body; a jar cover, which is connected to the Mason jar body and is located corresponding to position of the flexible part; middle of the sealing cover is provided with an air extracting hole, and the flexible part is provided at the air extraction hole; side surface of lower part of the flexible part is provided with air outlet holes. Through designing the flexible part to be assembled on the sealing cover, the invention has advantages of easy vacuuming, easy disassembly, not easy to leak, and long sealing cycle.

3 Claims, 5 Drawing Sheets

MASON JAR SEALING STRUCTURE

TECHNICAL FIELD

The invention relates to the technical field of sealing structure, in particular to a Mason jar sealing structure.

BACKGROUND ART

Mason jar sealing covers on the current market are usually designed for a specific size to be used with a specific negative pressure pump. This standardized size limitation reduces the applicability and flexibility of Mason jars, limiting the user's choice of different jar sizes.

Designs of sealing lids in prior art suffer from several problems, including a tendency to leak and a lack of long-lasting sealing effect. These problems stem from inadequate lid material or design, which can lead to a rapid deterioration of sealing effect during prolonged use or frequent opening and closing.

Many existing sealing covers are not user-friendly enough in design, and the process of disassembly and assembly is complicated, which is not only inconvenient for users to operate, but also easy to hurt their fingers in the process of using. In addition, improper operation may cause the sealing cover to pop open accidentally, which is a potential safety hazard.

Due to defects in the material or design of the sealing cover, the sealing cover is prone to be deformed or damaged during use, which leads to the need for users to frequently replace the sealing cover, increasing the cost of use and maintenance difficulties.

SUMMARY OF THE INVENTION

The technical problem to be solved by the invention is to provide a Mason jar sealing structure to solve the problem of sealing; through designing the flexible part to be assembled on the sealing cover, the invention has advantages of easy vacuuming, easy disassembly, not easy to leak, and long sealing cycle.

The Mason jar sealing structure of the invention is realized by the following technical solution, comprising

- a sealing cover, and a flexible part is provided on the sealing cover; the flexible part is located corresponding to position of negative pressure end of negative pressure pump;
- a Mason jar body, the Mason jar body is internally hollow, and the sealing cover is set covering opening of the upper Mason jar body;
- a jar cover, which is connected to the Mason jar body and is located corresponding to position of the flexible part;
- as a preferred technical solution, middle of the sealing cover is provided with an air extracting hole, and the flexible part is provided at the air extraction hole; side surface of lower part of the flexible part is provided with air outlet holes; when the negative pressure pump pumps air, the flexible part is deformed, the air inside the Mason jar body is pumped out through the air outlet hole; when the negative pressure pump stops pumping air, the flexible part is extruded at the air extracting hole under the action of the internal air pressure, which in turn plays a sealing role.

As a preferred technical solution, the jar cover is connected to the Mason jar body through thread, and lower end surface of the jar cover is in contact with the flexible part, and the lower end of the jar cover squeezes the flexible part to further increase its sealing effect.

As a preferred technical solution, the flexible part is raised upwardly, and the jar cover contacts and squeezes the flexible part when it is rotated and pressed downward.

As a preferred technical solution, upper end surface of the flexible part is larger than diameter of the air extracting hole.

The beneficial effect of the invention is as follows: through the provision of the flexible part, the flexible part is assembled on the sealing cover, and the air inside the Mason jar is extracted through pumping to form a negative pressure state, which further plays a sealing role;

- lower end surface of the jar cover squeezes the flexible part to further increase its sealing effect so as to make the invention has advantages of easy vacuuming, easy disassembly, not easy to leak, and long sealing cycle;
- In addition, by adopting the design of flexible part, the invention avoids the problem of cutting hands that may be caused by the traditional metal sealing cover, thus enhancing safety of operation;
- silicone material is less likely to be deformed during use than traditional materials, increasing the durability and service life of the sealing cover, and the design of entire sealing cover also facilitates cleaning and repeated use, reducing consumption and environmental burdens, and providing a solution for sustainable use.

BRIEF DESCRIPTION OF ACCOMPANY DRAWINGS

In order to more clearly illustrate the technical solutions in the embodiments or prior art of the invention, the accompanying drawings to be used in the description of the embodiments or prior art will be briefly described below. Obviously, only partial embodiments of the invention are shown and the actual structure is not limited thereto. It is to be understood by those skilled in the art that other drawings can be obtained based on the drawings of the invention with non-creative labor.

1 sealing cover, 2 Mason jar body, 3 jar cover, 4 flexible part, 5 air extracting hole, 6 air outlet hole, 7 negative pressure pump.

Specific Embodiment of the Invention

All features disclosed in the specification, or all steps in disclosed method or process, may be combined in any manner except for mutually exclusive features and/or steps.

Figure 1:
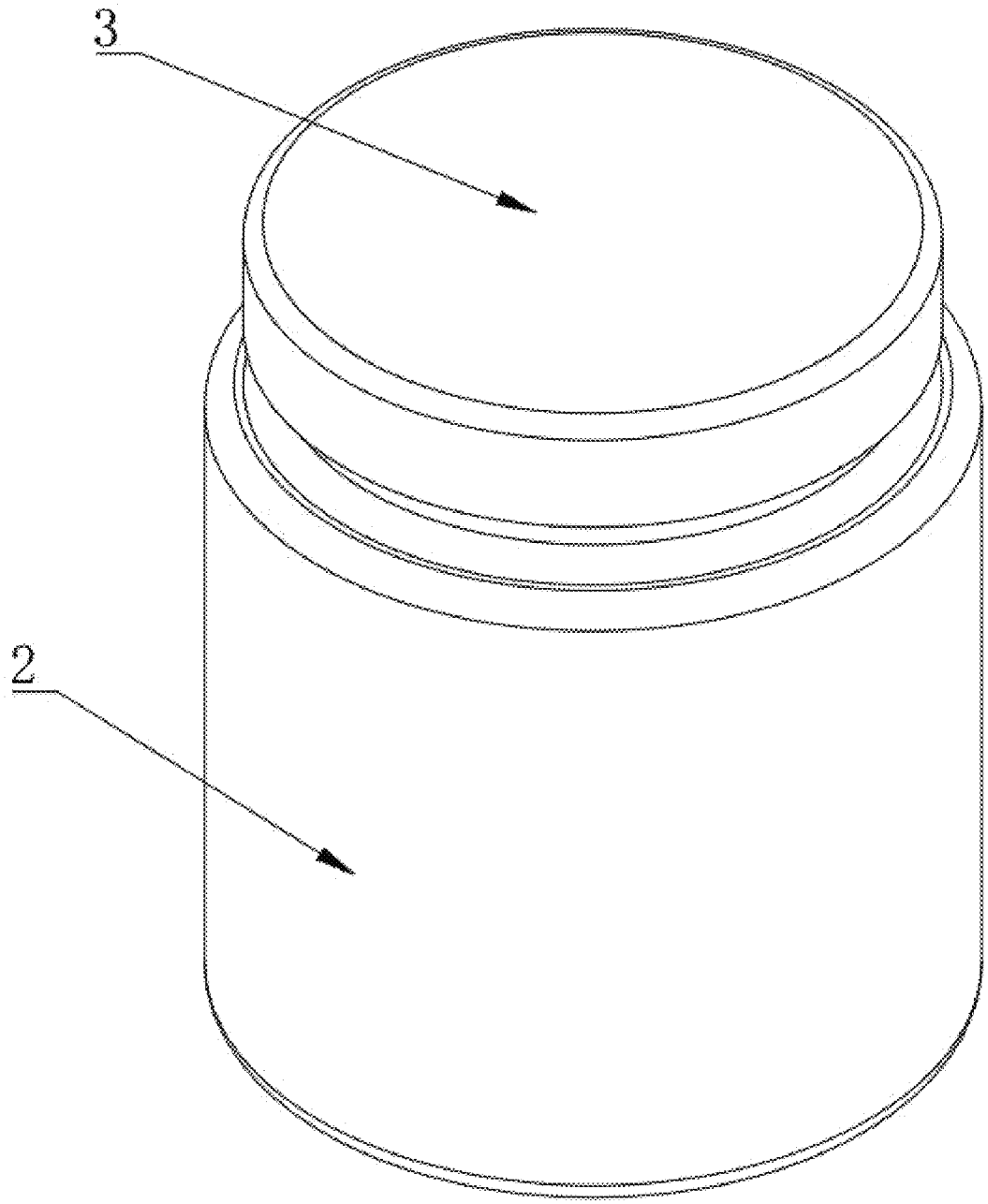
FIG. 1 is a stereogram of the invention.
Figure 2:
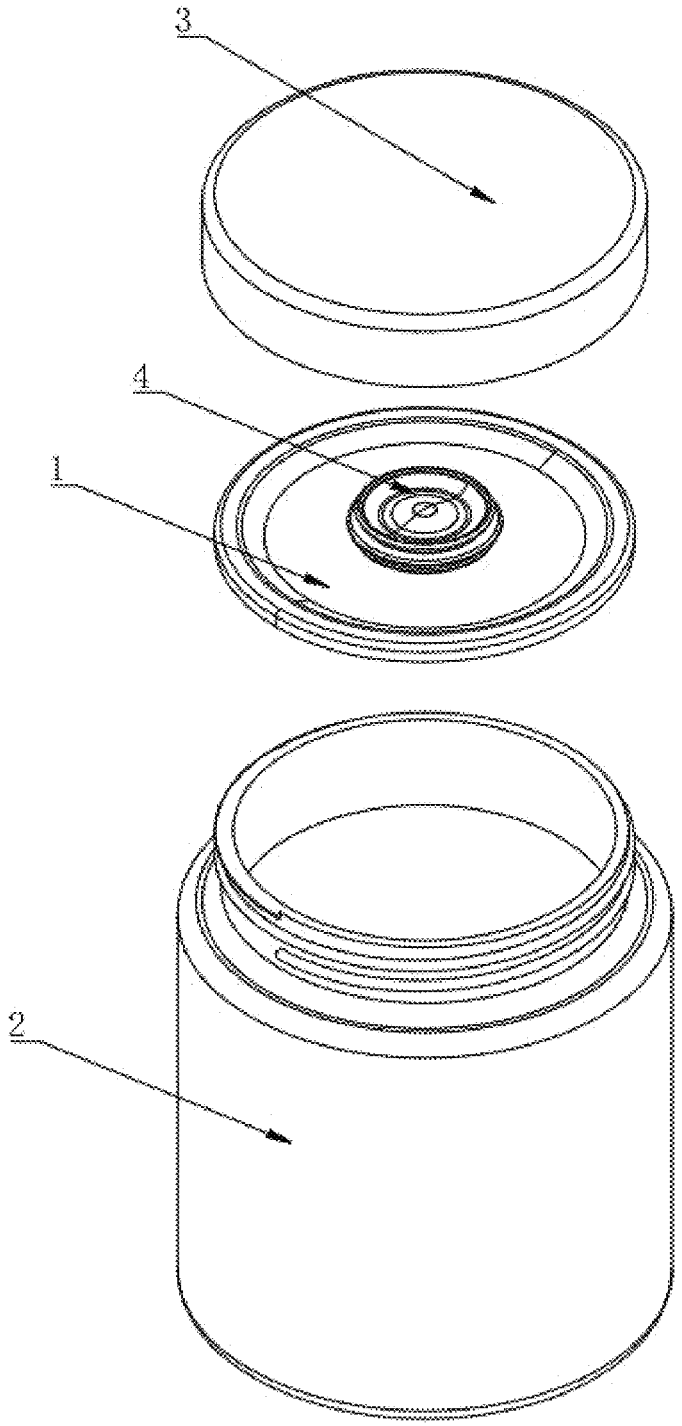
FIG. 2 is an exploded view of the invention.
Figure 3:
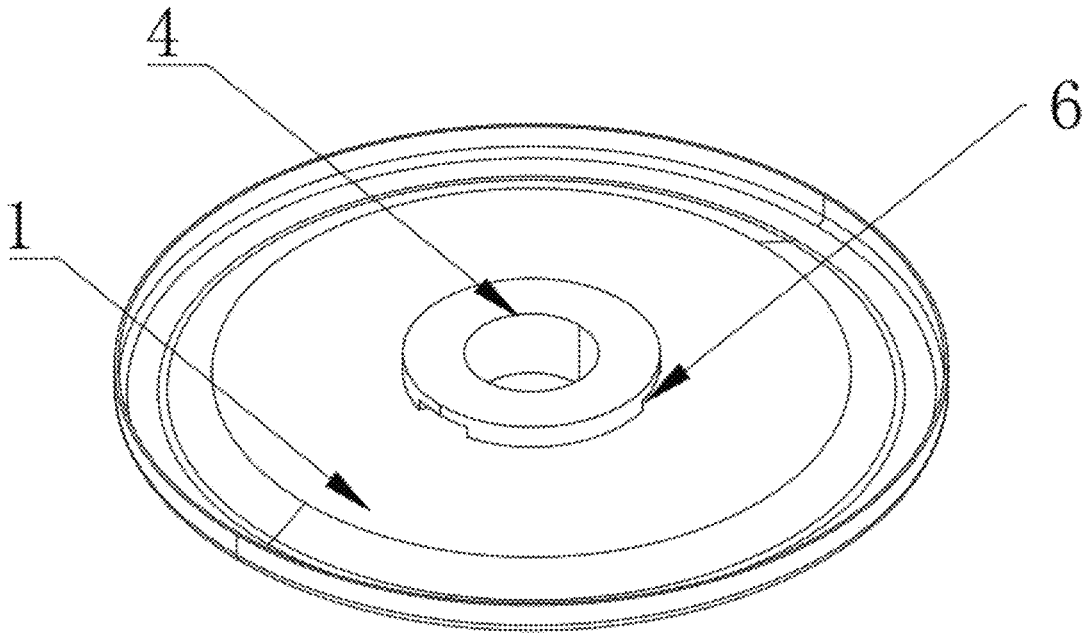
FIG. 3 is a structural diagram of the sealing cover of the invention.
Figure 4:
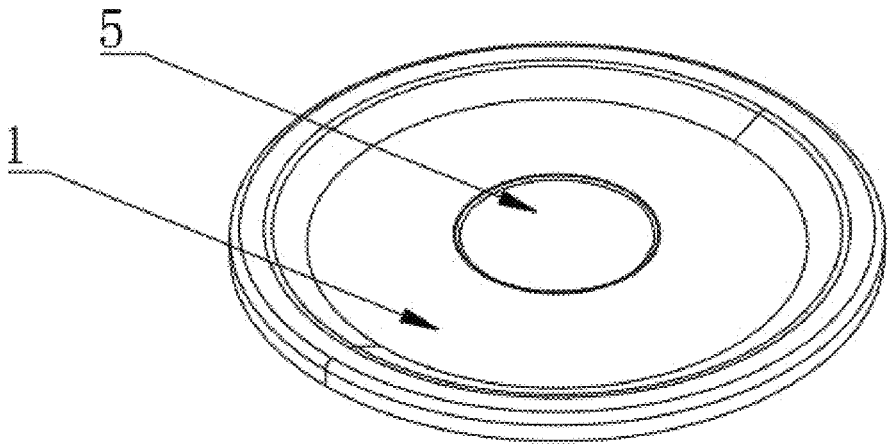
FIG. 4 is a diagram of air extracting hole of the invention.
Figure 5:
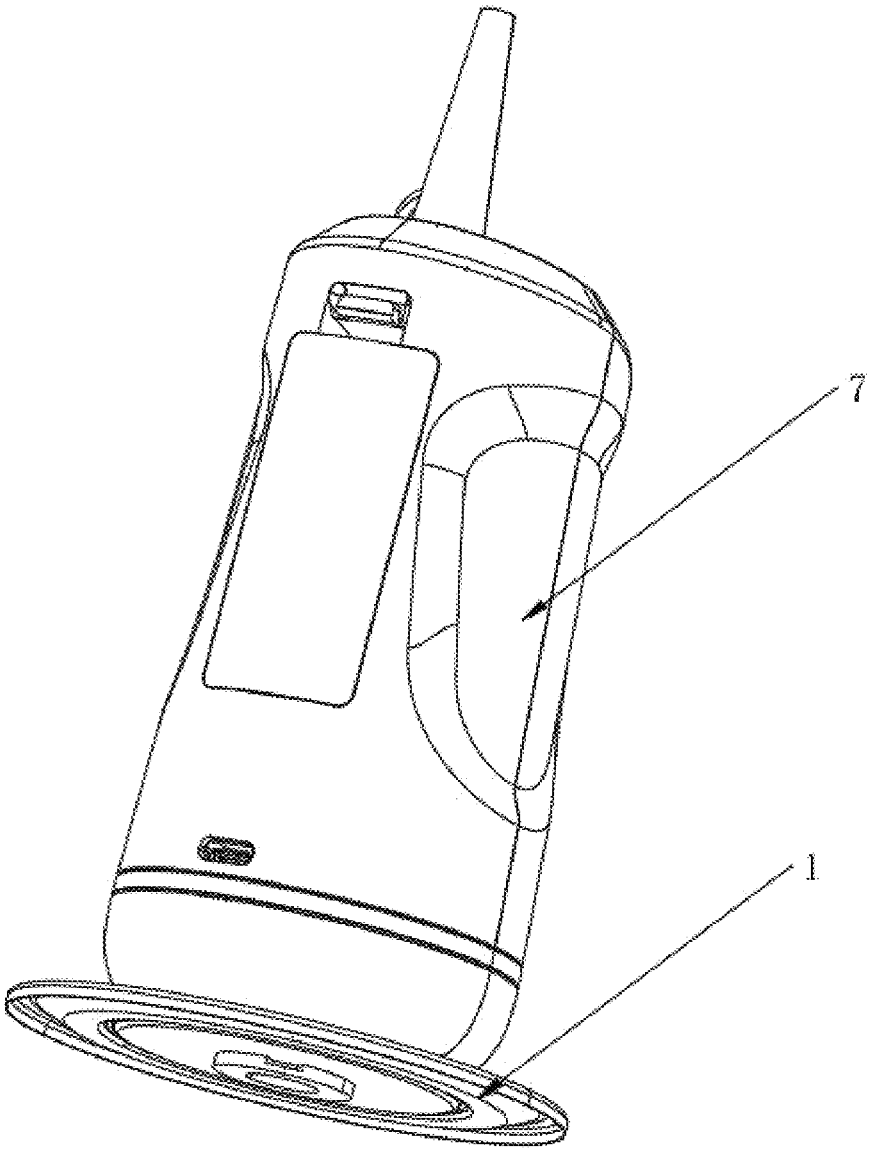
FIG. 5 is a diagram of the invention in negative pressure state.

As shown from FIG. 1 to FIG. 3, a Mason jar sealing structure of the invention comprises a sealing cover 1, and a flexible part 4 is provided on the sealing cover 1, which in this embodiment may be a silicone part, or of course other flexible material; as shown in FIG. 5, the flexible part 4 is located corresponding to position of negative pressure end of negative pressure pump 7;

- the invention also includes a Mason jar body 2, the Mason jar body 2 is internally hollow, and the sealing cover 1 is set covering opening of the upper Mason jar body 2;

the invention also includes a jar cover 3, which is connected to the Mason jar body 2 and is located corresponding to position of the flexible part 4;

as shown in FIG. 4, middle of the sealing cover 1 is provided with an air extracting hole 5, and the flexible part 4 is provided at the air extraction hole 5; the flexible part 4 is raised upwardly to facilitate the jar cover 3 contacting and squeezing the flexible part 4 when it is rotated and pressed downward.

side surface of lower part of the flexible part 4 is provided with air outlet holes 6; when the negative pressure pump 7 pumps air, the flexible part 4 is deformed, the air inside the Mason jar body 2 is pumped out through the air outlet hole 6; when the negative pressure pump 7 stops pumping air, the flexible part 4 is extruded at the air extracting hole 5 under the action of the internal air pressure, which in turn plays a sealing role.

Wherein, the jar cover 3 is connected to the Mason jar body 2 through thread, and lower end surface of the jar cover 3 is in contact with the flexible part 4, and the lower end of the jar cover 3 squeezes the flexible part 4 to further increase its sealing effect.

In addition, upper end surface of the flexible part 4 is larger than diameter of the air extracting hole 5 to prevent the flexible part 4 from being pumped into the Mason jar body 2 under air pressure.

The invention and its embodiments have been described above, but the description is not limited thereto; only one embodiment of the invention is shown in the drawings, and the actual structure is not limited thereto. In general, it is to be understood by those skilled in the art that non-creative design of structural forms and embodiments that are similar to the technical solutions without departing from the spirit of the invention shall all fall within the protective scope of the invention.

What is claimed is:

1. A Mason jar sealing structure, comprising:

a sealing cover, and a flexible part with deformation capability is provided on the sealing cover;

a Mason jar body, the Mason jar body is internally hollow, and the sealing cover is set covering opening of the upper Mason jar body;

a jar cover, which is connected to the Mason jar body and is used for secondary external sealing;

when the Mason jar body is vacuumized, the flexible part is sunken inwards by negative pressure;

wherein middle of the sealing cover is provided with an air extracting hole, and the flexible part is provided at the air extraction hole;

side surface of lower part of the flexible part is provided with air outlet holes.

2. The Mason jar sealing structure of claim 1, wherein the jar cover is connected to the Mason jar body through thread, and lower end surface of the jar cover is in contact with the flexible part, and the lower end of the jar cover squeezes the flexible part.

3. The Mason jar sealing structure of claim 1, wherein upper end surface of the flexible part is larger than diameter of the air extracting hole.

* * * * *